US009279565B1

(12) United States Patent
Marinus et al.

(10) Patent No.: US 9,279,565 B1
(45) Date of Patent: Mar. 8, 2016

(54) LAMP

(71) Applicant: KONINKLIJKE PHILIPS N.V., Eindhoven (NL)

(72) Inventors: Antonius Adrianus Maria Marinus, Eindhoven (NL); Vincent Stefan David Gielen, Eindhoven (NL); Reinier Imre Anton Den Boer, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/833,208

(22) Filed: Aug. 24, 2015

(30) Foreign Application Priority Data

Aug. 27, 2014 (EP) ..... 14182491

(51) Int. Cl.

| | |
|---|---|
| ***F21V 1/06*** | (2006.01) |
| ***F21V 11/00*** | (2015.01) |
| ***F21V 21/00*** | (2006.01) |
| ***F21V 11/18*** | (2006.01) |
| ***F21K 99/00*** | (2010.01) |
| ***F21V 5/02*** | (2006.01) |
| ***F21V 17/02*** | (2006.01) |
| ***F21V 3/02*** | (2006.01) |
| ***F21V 3/04*** | (2006.01) |
| ***F21V 23/00*** | (2015.01) |
| ***F21V 29/89*** | (2015.01) |
| *F21Y 101/02* | (2006.01) |

(52) U.S. Cl.

CPC ..... *F21V 11/186* (2013.01); *F21K 9/1355* (2013.01); *F21V 3/02* (2013.01); *F21V 3/0427* (2013.01); *F21V 3/0445* (2013.01); *F21V 5/02* (2013.01); *F21V 17/02* (2013.01); *F21V 23/003* (2013.01); *F21V 29/89* (2015.01); *F21Y 2101/02* (2013.01)

(58) Field of Classification Search

CPC ..... F21V 11/186; F21V 3/02; F21V 5/02; F21V 23/003; F21V 29/89; F21V 3/0427; F21V 3/0445; F21V 17/02; F21K 9/1355; F21Y 2101/02

See application file for complete search history.

(56) References Cited

U.S. PATENT DOCUMENTS

| | | | |
|---|---|---|---|
| 8,227,962 | B1 | 7/2012 | Su |
| 2003/0031015 | A1 | 2/2003 | Ishibashi |
| 2013/0258657 | A1 | 10/2013 | Lin et al. |

FOREIGN PATENT DOCUMENTS

| | | | |
|---|---|---|---|
| CN | 103185280 | A | 7/2013 |
| CN | 203395668 | U | 1/2014 |
| CN | 103672753 | A | 3/2014 |
| DE | 102012220264 | A1 | 5/2014 |
| GB | 2366610 | A | 3/2002 |

*Primary Examiner* — Donald Raleigh

(57) ABSTRACT

A lamp is provided, the lamp comprising a one piece envelope (102) mounted on a base (104), an internal structure (106) arranged within the envelope (102), the internal structure (106) comprising a stem (108) extending from the base (104), a solid state light source (110) arranged on the stem (108), and a screen (112, 212) obscuring at least a portion of light emitted from the solid state light source (110) such that light emitted from the solid state light source (110) is diffused by the screen (112, 212), wherein the stem (108) is arranged to support the screen (112, 212), wherein the screen (112, 212) is arranged to adopt a collapsed state such that the screen (112, 212) is passable through a base opening (115) of the envelope (102) and an un-collapsed state (116) such that the screen (112, 212) is impassable through the base opening (115) of the envelope (102).

15 Claims, 2 Drawing Sheets

LAMP

CROSS-REFERENCE TO PRIOR APPLICATIONS

This application claims the benefit of European Patent Application No. 14182491.2, filed on Aug. 27, 2014. This application is hereby incorporated by reference herein.

FIELD OF THE INVENTION

The present invention relates to a lamp for improved light output.

BACKGROUND OF THE INVENTION

The fact that the solid state light source is a small light source presents opportunities as well as challenges. On the one hand the small size of the solid state light source allows for lamps having a compacter design, but on the other hand it is challenging to obtain efficient light distribution from such lamps. It is further challenging to avoid the light emitted from the solid state light source to appear as high brightness spots in the lamp.

Hence, there is a need for solid state based lamps that are able to provide efficient uniform illumination.

SUMMARY OF THE INVENTION

It is an object of the present invention to provide a lamp having uniform illumination and which assembly is efficient.

According to a first aspect of the invention, this and other objects are achieved by providing a lamp. The lamp comprising, a one piece envelope mounted on a base, an internal structure arranged within the envelope, the internal structure comprising a stem extending from the base, a solid state light source arranged on the stem, and a screen obscuring at least a portion of light emitted from the solid state light source such that light emitted from the solid state light source is diffused by the screen, wherein the stem is arranged to support the screen, wherein the screen is arranged to adopt a collapsed state such that the screen is passable through a base opening of the envelope and an uncollapsed state such that the screen is impassable through the base opening of the envelope.

The structure of the lamp is advantageous as it provides a lamp that is simple to assemble. The solid state light source being arranged on the stem further offers improved thermal management as heat generated by the solid state light source is led away via the stem by heat conduction.

The screen obscures light emitted from the solid state light source such that direct viewing of the solid state light source is obstructed by the screen in certain predetermined directions. The screen therefore reduces problems such as glare for a person viewing the lamp along the predetermined directions.

The size of the screen determines the angular span of the predetermined directions and the area of the lamp that provides light emission. Hence, the size of the light emitting area sets the light intensity of the lamp.

In other words, the screen diffuses light emitted from the solid state light source such that a light emitting area of the lamp is larger than the physical size of the solid state light source.

Light emitted from the solid state light source is further effectively redistributed in space. An increased multi-directionality of the light emitted from the lamp is therefore obtained.

The wording screen should be interpreted in it broadest sense and should be understood as an elongated object that covers or masks at least a portion of the light emitted from the solid state light source. The screen diffuses light from the solid state light source. In other words the screen scatters, refracts and/or reflects a portion of the light emitted from the solid state light source over a larger angular space.

The stem supports the screen such that position of the screen within the envelope is maintained which increases the robustness of the lamp.

By the wording stem is to be understood an elongated structure such as a shaft or a beam which is arranged to support and/or hold another object.

The screen being arranged to adopt a collapsed state is also advantageous as it allows the screen to reduce its extension such that the screen is passable through the base opening. This allows for simplified assembly of the lamp. The screen is further impassable through the base opening when the screen is in the un-collapsed state. The screen has in it un-collapsed state an extension that is larger than the base opening. This allows for a lamp comprising a screen having an increased light emitting area where the screen is insertable into the envelope.

The collapsed state should be understood as a condition in which the screen is shrunk in size. In other words, the shape of the screen is more compact such that may be moved through the base opening. In contrast, the un-collapsed state refers to a condition where the screen is expanded in size having an extension such that it in this condition cannot be moved through the base opening.

To this end the wording passable should be construed as that an object is capable of being passed through an opening and/or a channel. Impassable should further be construed as that an object is incapable of being passed through an opening and/or a channel. The opening is here the base opening.

The screen may be flexible and/or foldable such that screen adopts the collapsed state or the un-collapsed state. This simplifies the transformation from the collapsed to the un-collapsed state and vice versa.

The wording flexible screen is here to be understood as a screen being bendable such that a force that acts on the screen may change the shape of the screen. The screen is pliable such that it may be bent without breaking. The screen may be continuously flexible such that the screen may be bent at any point along the screen. The screen may be flexed repeatedly such that the same screen may acquire different shapes. Alternatively, the screen may comprise sections which are flexible.

The wording foldable screen should be construed as the screen being jointed such that the screen may be bent at discrete points along its extension. The screen may comprise hinges. By folding the screen at a joint the shape of the screen may be changed. The screen may comprise a section in the vicinity of a joint or in between two joints that are inflexible.

The screen may be resilient such that it may return to an original shape after being flexed and/or folded.

The screen may surround the stem. This is advantageous as the screen increases the directions at which light is emitted from the lamp. Light emitted from the solid state light source is thereby effectively redistributed in space.

The stem may be centrally arranged in the envelope as this simplifies the assembly of the lamp and allows for a rotationally symmetric lamp arrangement.

The base opening may face the stem along an axial extension of the stem which further simplifies the assembly of the lamp.

The screen may comprise a light diffusive layer. The amount of material of the screen that diffuses light from the solid state light source may thereby be reduced without reducing the portion of light that is diffused. A more cost effective screen may thereby be provided.

The light diffusive layer may comprise a prismatic structure which allows for efficient redistribution of light emitted from the solid state light source.

The stem may be arranged to house driver electronics for driving the solid state light source. A more compact lamp may thereby be obtained. Heat generated by the driver electronics may further be led away via the stem increasing the performance and durability of the driver electronics. A more effective and durable lamp may thereby be provided.

The solid state light source may be arranged to emit light with a cone of light centred in a direction being perpendicular to the axial extension of the stem which improves the efficiency at which light is diffused by the screen.

The stem may comprise a thermal conductive material which provides efficient heat transport and offers stability to the stem.

The thermal conductive material may comprise a metal, preferably aluminium.

The envelope may be translucent.

The wording transparent is to be understood as "able to be seen through".

The envelope may comprise a glass or a plastic. This allows for a cost effective fabrication of the light guide.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figure, the sizes of layers and regions are exaggerated for illustrative purposes and, thus, are provided to illustrate the general structures of embodiments of the present invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
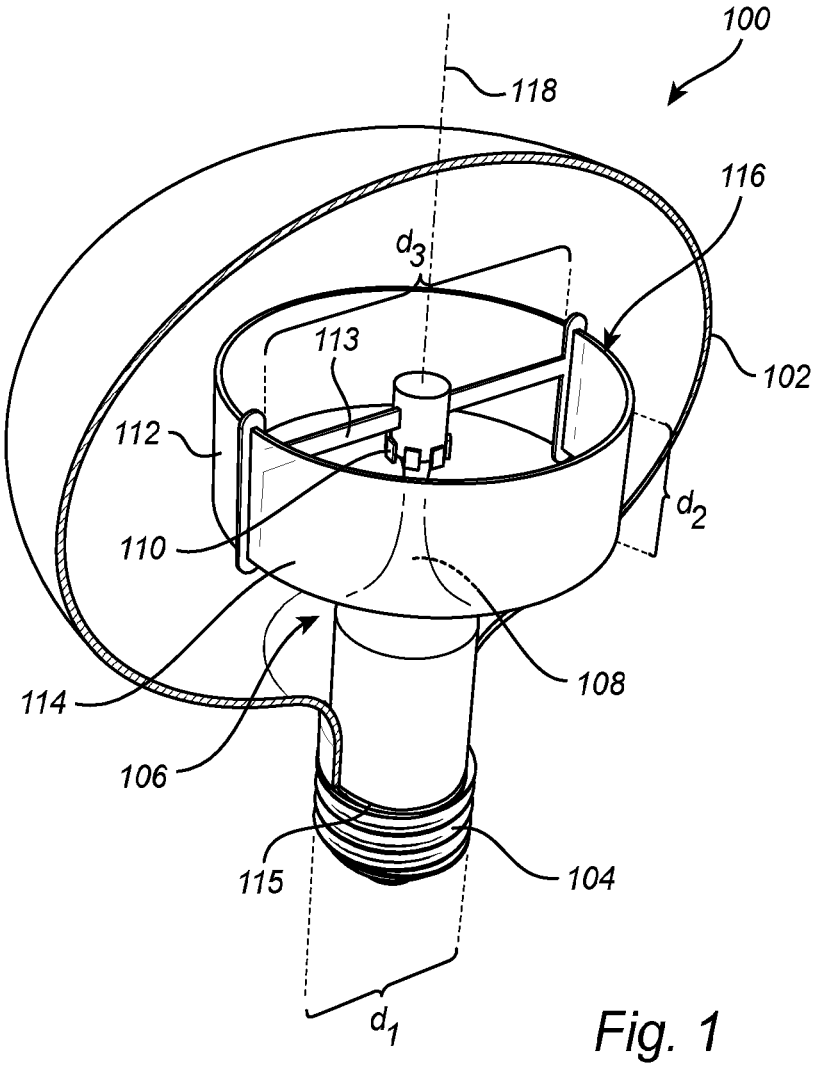
FIG. 1 illustrates a perspective view of a lamp according to one embodiment of the present invention.

FIG. 1 illustrates a perspective view of a lamp 100 according to an embodiment of the present invention. The lamp 100 comprises an envelope 102 mounted on a base 104 and an internal structure 106. The internal structure 106 is arranged within the envelope 102 and comprises a stem 108 which extend from the base 104. Solid state light sources 110 are further arranged on the stem 108. This arrangement is advantageous as the stem 108 offers improved thermal management. In other words, heat generated within the solid light sources 110 may thereby be led from the light sources 110, offering an improved light efficiency and increased life time of the solid light sources 110. To this end, driver electronics (not shown) for powering the solid state light sources 110 is housed within the stem 108. Heat generated by the driver electronics may thereby also be more efficiently led away via the stem 108 which increases the performance and durability of the driver electronics.

The internal structure 106 comprises a screen 112 arranged to obscure light emitted from the solid state light sources 110. The screen 112 surrounds the stem 108 and the solid state light sources 110. The stem 108 is further arranged to support the screen 112 such that position of the screen 112 within the envelope 102 is maintained at a predetermined position. The lamp further comprises a support member 113 arranged on the stem 108 which assists maintaining the shape of the screen 112.

The skilled person in the art realizes that the shape of the stem 108 and/or the shape of the support member 113 may differ in different embodiments as long as support for the solid state light sources and the screen is provided.

One purpose of the screen 112 is to diffuse at least a portion of light emitted from the solid state light source 110. This is advantageous as direct viewing of the solid state light source 110 may be obstructed by the screen 112 in certain predetermined directions. The screen 112 therefore reduces problems such as glare which may cause discomfort or disability for a person viewing the lamp 100.

The size and/or shape of the screen 112 determines the portion of the light emitted from the solid state light source 110 that is diffused by the screen 112. The screen 112 in the embodiment of FIG. 1 has a cylindrical shape. The portion of the light emitted from the solid state light sources 110 may be changed by changing the width $d_2$ and/or the extension of the screen $d_3$. The angular span of the predetermined directions along which the light is obstructed may thereby be changed.

Another purpose of the screen 112 is to provide a light emitting area 114 that is larger than the physical size of the solid state light sources 110. This is accomplished by the screen 112 providing a light emitting area 114 which diffusively scattered light emitted from the solid state light source 110. By tuning the size, i.e. light emitting area 114, of the screen 112 the light intensity of the lamp 100 may be changed without changing the power of the solid state light sources 110.

Multi-directional light emission from the lamp 100 is further achieved as the screen 112 surrounds the stem 108 and the solid light sources 110. In other words, the screen 112 increases the angles at which light is emitted from the lamp 100. Light emitted from the solid state light sources 110 is thereby effectively redistributed in space. As a consequence the lamp 100 may comprise a fewer number of solid state light sources 110, while providing a predetermined multi-directional light emission distribution. This arrangement is therefore cost beneficial. The lamp may accordingly only comprise one solid state light source.

The solid state light source 110 may according to one embodiment be a light emitting diode (LED).

The stem 108 is further made of aluminium as this material provides the desired heat conduction, is light and strong enough to support the screen 112.

The envelope 102 is in one piece, which simplifies the fabrication of the lamp 100. The envelope 102 comprises a base opening 115 through which the stem 108 is arranged to be inserted into the envelope 102. The base opening 115 is preferably facing the base 104 of the lamp 100 as this further simplifies assembly of the lamp 100.

The envelope may in other embodiments comprise several parts that are for instance welded, glued or press-fit together to form a one-piece envelope prior to the insertion of the stem and the screen into the envelope.

The envelope 102 is in FIG. 1 formed as a bulb, but may in other embodiments take the form other forms such as a sphere, cylinder, drop, or a dome.

The envelope may comprise a glass or a plastic which provides a durable and cost effective lamp.

The screen 112 has in an un-collapsed state 116 an extension such that the screen 112 is impassible through the base opening 115. As illustrated in FIG. 1, the base opening 115 has a cross-section $d_1$ and the screen 112 has an extension $d_3$ being larger than the cross-section $d_1$. In a collapsed state (not shown) at least the extension along one direction of the screen 112 is smaller than the base opening cross-section $d_1$.

The screen 112 is according to the embodiment of FIG. 1, flexible. In other words, the screen 112 is bendable such that a force applied on the screen 112 may change the shape of the screen 112 such that it is insertable into the envelope 102 via the base opening 115. This is advantageous as it simplifies the assembly of the lamp 100.

The base opening 115 faces the stem 108 along an axial extension 118 of the stem which further simplifies the assembly of the lamp 100.

The solid state light sources are further arranged to emit light with a cone of light centred in a direction being perpendicular to the axial extension 118 of the stem 108 which improves the efficiency at which light is diffused by the screen 112.

According to one embodiment the flexible screen 112 has a width $d_2$ also being larger than the cross-section $d_1$. In other words, the screen 112 has at least one dimension that, in an uncollapsed state, is larger than the base opening 115 of the envelope 102 but the screen 112 may in a collapsed state be inserted through the base opening 115. Hence, it is possible to provide a screen 112 having a width $d_2$ and/or an extension $d_3$ that is larger than the cross-section $d_1$ of the base opening 115.

According to other embodiments the screen is foldable. The screen may in such an embodiment comprise hinges which provide a folding function to the screen. By folding the screen at a joint formed by the hinges the shape of the screen may be changed prior to and/or after insertion into the envelope of the lamp. It should be noted that the screen may comprise a section in the vicinity of a joint or in between two joints that are inflexible as long as the screen may be arranged within the envelope.

The screen may comprise a light diffusive layer (not shown). The amount of material of the screen that diffuses light from the solid state light source may thereby be reduced without reducing the portion of light that is diffused. A more cost effective screen may thereby be provided.

The screen may comprise a prismatic structure (not shown) which allows for efficient redistribution of light emitted from the solid state light source. The light diffuser layer is arranged to, by scattering, diffraction and/or reflection, provide spreading and homogenization of non-uniform light.

The diffusive layer may comprise a brightness enhancement film, BEF, which utilizes refraction and reflection at multiple surface structures to increase the efficiency at which light is being refracted and reflected by the film. More specifically, the brightness enhancement film refracts light within a viewing cone along a certain viewing direction of the screen, typically perpendicular to the film. The viewing cone may for example be up to 35 degrees of the viewing direction. Light reaching the brightness enhancement film at angles greater than those of the viewing cone is reflected back. The reflected light may, after multiple reflections, be emitted through the film. In other words, the reflected light is recycled and an increased portion of light being diffused by the screen may be obtained.

The screen may in other embodiments comprise an optical lighting foil, OLF. The OLF may be a continuous thin film incorporating microscopic prisms with corners having 90 degrees edges at an outer surface of the OLF such that increased light reflectance of light entering the OLF at an inner surface of the OLF is obtained.

The screen may comprise a holographic film including a hologram, which is configured to turn light emitted by the solid state light source which is incident on the holographic film such that the turned light is reflected and propagates away from the screen at angles within a predetermined view cone. Hence, the holographic film may change the direction of the light emitted by the solid state light source such that the light is diffused by the screen.

The hologram may be pixilated. Different pluralities of the pixels of the hologram can be configured to turn light incident on the hologram from different directions.

Different pluralities of the pixels of the hologram also can be configured to turn light of different colors.

The holographic film may be a brightness enhancement film.

According to one embodiment, the lamp may comprise a plurality of screens which allows for improved tailoring of the portion of light emitted from the solid state light source(s) of the lamp that is diffused by the screens.

Figure 2:
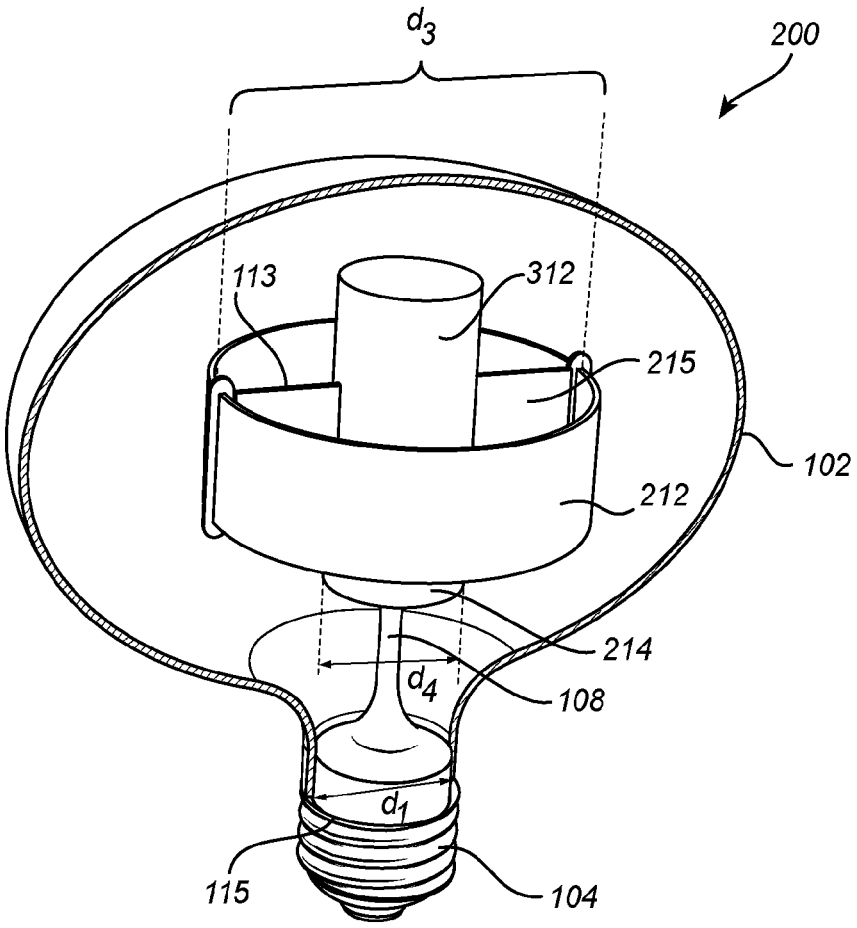
FIG. 2 illustrates a perspective view of a lamp according to another embodiment of the present invention.

To this end, FIG. 2, illustrates a perspective view of a lamp 200 comprising a screen 212 and an additional screen 312. The additional screen 312 has the shape of an elongated cylinder thereby obscuring a larger portion of the light emitted from the solid state light sources (not shown) than the screen 212. Direct viewing of the solid state light sources are thereby obstructed by the additional screen 312 in predetermined directions, where the angular span of the predetermined directions can be changed by changing the extension of the additional screen 312. The size of the additional screen 312 may further be used to set the light intensity of the lamp 200. In other words, by tuning light emitting area 214 of the additional screen 312 the light intensity of the lamp 200 may be changed without changing the power of the solid state light sources.

Both the screens 212 and 312 diffuse light emitted from the solid state light sources of the lamp 200. By choosing screens 212 and 312 having different optical properties the visual appearance of the lamp 200 and/or the light output from the lamp 200 may be tailored. The lamp 200, for example, comprises a translucent additional screen 312 and a screen 212 comprising an inner light reflective surface 215. Light emitted from the solid state light sources is thereby effectively redistributed in space such that an increased multi-directionality of the light emitted from the lamp 200 is obtained.

The additional screen 312 of FIG. 2 has an extension $d_4$ being smaller than the cross-section $d_1$ of the base opening 115. The additional screen 312 may thereby be inserted through the base opening 115 of the lamp 200 which simplifies the assembly of the lamp 200.

According to other embodiments the additional screen may have an extension being larger than the cross-section of the base opening, the additional screen being arranged to adopt a collapsed state allowing the additional screen to reduce its extension such that the additional screen is passable through the base opening.

The skilled person in the art realizes that a lamp may comprise more than two screens.

The person skilled in the art further realizes that the present invention by no means is limited to the preferred embodiments described above. On the contrary, many modifications and variations are possible within the scope of the appended claims.

For example, in an embodiment the solid state light source could be an organic light emitting diode (OLED).

The screen may comprise a reflector element (not shown). The wording reflector element should be construed as an object that reflects light. The reflector element has preferably a shape such that it may be arranged to cover at least a portion of the screen which is facing the stem. This increase the amount of light emitted from the solid state light source that is redirected by the screen. The reflector element may be fully or partly reflecting.

It should be noted that the lamp may comprise a plurality of solid state light sources which provide light emission showing similar or different spectral compositions.

The screen(s) may comprise a polycarbonate film or acrylic film. The screen may comprise a printed canvas.

The screen(s) may comprise a preformed sheet, for example containing, next to optical characteristics, also decorative 3D shapes. The 3D shapes may e.g. be in the form of one or more thermoformed sheets. The 3D shapes may e.g. be random or specifically shaped for example to visualize a specific pattern or a specific shape such as a chandelier.

The screen(s) may comprise optical elements consisting of a combination of curved, axis symmetric, flat, spiral and/or random (e.g. wire bundles) optical surfaces, like in a chandelier.

The screen(s) may comprise one or more wires (e.g. steel wires). The wire(s) may be coated with a polymer.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or an does not exclude a plurality. The mere fact that certain measures are recited in mutually different dependent claims does not indicate that a combination of these measured cannot be used to advantage.

The invention claimed is:

1. A lamp comprising, a one piece envelope mounted on a base, an internal structure arranged within the envelope, the internal structure comprising a stem extending from the base, a solid state light source arranged on the stem, and a screen obscuring at least a portion of light emitted from the solid state light source such that light emitted from the solid state light source is diffused by the screen, wherein the stem is arranged to support the screen, wherein the screen is arranged such that the screen is capable of being passable through a base opening of the envelope and an un-collapsed state such that the screen is impassable through the base opening of the envelope.

2. The lamp according to claim 1, wherein the screen is flexible and/or foldable such that the screen is capable of being passable through the base opening of the envelope.

3. The lamp according to claim 1, wherein the screen is surrounding the stem.

4. The lamp according to claim 3, wherein the stem is centrally arranged in the envelope.

5. The lamp according to claim 4, wherein the base opening has a cross-section, d1, and wherein the screen in its uncollapsed state has an extension, d3, being larger than the cross-section, d1.

6. The lamp according to claim 5, wherein the base opening is facing the stem along an axial extension of the stem.

7. The lamp according to claim 6, wherein the screen comprises a light diffusive layer.

8. The lamp according to claim 7, where the light diffusive layer comprises a prismatic structure.

9. The lamp according to claim 8, wherein the envelope is formed as a bulb.

10. The lamp according to claim 9, wherein the stem is arranged to house driver electronics for driving the solid state light source.

11. The lamp according to claim 10, wherein the solid state light source is arranged to emit light with a cone of light centered in a direction being perpendicular to the axial extension of the stem.

12. The lamp according to claim 11, wherein the stem comprises a thermal conductive material.

13. The lamp according to claim 12, wherein the thermal conductive material comprises a metal, preferably aluminium.

14. The lamp according to claim 13, wherein the envelope is transparent.

15. The lamp according to claim 14, wherein the envelope comprises a glass or a plastic.

* * * * *